United States Patent [19]

Plösser

[11] Patent Number: 5,030,134

[45] Date of Patent: Jul. 9, 1991

[54] CONNECTING DEVICE FOR USE WITH FINE WIRE

[75] Inventor: Hartmuth G. F. Plösser, Lautertal, Fed. Rep. of Germany

[73] Assignee: AMP Incorporated, Harrisburg, Pa.

[21] Appl. No.: 540,077

[22] Filed: Jun. 19, 1990

[30] Foreign Application Priority Data

Jun. 29, 1989 [GB] United Kingdom ..... 8914987

[51] Int. Cl.[5] ..... H01R 4/24

[52] U.S. Cl. ..... 439/434; 439/84

[58] Field of Search ..... 439/387, 388, 411–415, 439/418, 431, 433, 434, 783, 82, 84, 751, 392, 393

[56] References Cited

U.S. PATENT DOCUMENTS

| | | | |
|---|---|---|---|
| 3,249,908 | 5/1966 | Fuller et al. | 439/393 |
| 4,169,645 | 10/1979 | Faulconer | 439/392 |
| 4,530,560 | 7/1985 | Weidler | 439/842 |

FOREIGN PATENT DOCUMENTS

| | | | |
|---|---|---|---|
| 2162209 | 6/1973 | Fed. Rep. of Germany | 439/411 |
| 944544 | 12/1963 | United Kingdom . | |
| 970226 | 9/1964 | United Kingdom . | |
| 1213013 | 11/1970 | United Kingdom . | |
| 1235978 | 6/1971 | United Kingdom . | |
| 1350804 | 4/1974 | United Kingdom . | |
| 1489721 | 10/1977 | United Kingdom . | |

OTHER PUBLICATIONS

Search Report from GB Patent Office dated 10/23/90.

*Primary Examiner*—David L. Pirlot

*Attorney, Agent, or Firm*—Bruce J. Wolstoncroft

[57] ABSTRACT

A connecting device for use with fine wire (20) and the like has a post (14) and a sleeve (6), each of which have tapered portions. The sleeve (6) surrounds the post (14) and has an inner surface which extends longitudinally along the sleeve (6) length. A space is provided between the post (14) and the sleeve (6) when the post (14) is fitted into the sleeve (6), the space dimensioned to receive at least one conductive lead (20) therein. The conductive leads (20), post (14) and sleeve (6) are configured such that as the post (14) is axially driven relative to the sleeve (6), the lead (20) is substantially deformed in a termination zone which has serrations (18) provided therein and the post (14) is wedged into an interlocking frictional fit within the sleeve (6) to entrap and terminate the lead (20) to the post (14) and the sleeve (6). A cutting blade (22) is provided proximate the serrations (18) to severe the lead (20) when the post (14) is terminated in the sleeve (6). A strain relief portion (24) is also provided proximate the serrations (18), the strain relief portion (24) cooperates with the lead (20) to insure that the lead (20) will not be damaged as a force is applied thereto.

12 Claims, 3 Drawing Sheets

22
6
14
18
20
18

14
28
10
8
22
2
18
26
24
9
6
20

14
28
10
8
2
22
18
9
6
20
24
26

CONNECTING DEVICE FOR USE WITH FINE WIRE

FIELD OF THE INVENTION

The invention relates to a device for connecting insulated electrical conductors. In particular the device is directed to an electrical connector which terminates small diameter wires to a printed circuit board or the like.

BACKGROUND OF THE INVENTION

The usage of very small electrical conductors has created connecting and terminating problems which can not be adequately handled by the electrical connectors which were designed to electrically connect and terminate larger wires. One problem which is created by the use of small conductors, is that the very small conductors are physically difficult to handle or manipulate with respect to the usual connector components. Another difficulty associated with the small conductors relates to the relatively disproportionate strength of the conductor insulating material which is generally provided about the fine wire. The foregoing factors are further complicated in situations wherein it is desirable to interconnect fine wire conductors of different diameters or, to connect fine wire conductors to printed circuit conductive paths.

One solution to the problem of terminating fine wire is described in U.S. Pat. No. 3,249,908. The electrical connector disclosed includes a post member adapted to be wedged within an eyelet or sleeve member to entrap one or more conductors therebetween and terminate such to the conductive material of the members. Either the post or the eyelet member is provided with small serrations extending radially about the member which operate to remove the insulation from conductors. As a basic part of the invention, the post and eyelet members are provided with distinctly different tapers, with that of the eyelet member being larger. This feature has been discovered to permit termination of different size conductors by the same post and eyelet assembly at the same time and to preclude accidental snipping off of conductors through the provision of an inherent strain relief to the conductor as it enters into the eyelet member and is terminated. Additionally, this feature permits a wide variation in insertion force since the post can effectively terminate a conductor without pinching it off even though forced into the eyelet well beyond the point necessary for termination. The conductor terminated is left in a configuration defined by the difference in taper and which is itself tapered out from a point of near normal thickness to a thinned end with a broad area of contact interface being defined.

Although the above-referenced patent discloses a viable manner in which to terminate fine wires, several problems are associated therewith. As the wire is terminated, the cooperation of the serrations with the walls of the sleeve member trap the conductors therebetween, thereby holding the conductors in position. However, if a force is applied to a respective conductor, the force will be transmitted through the conductor to the point at which the serrations and walls are in cooperation with the conductors. As the conductors have been deformed in this termination zone, the conductors are relatively weak in this zone. Consequently, a force applied to the conductors may result in the failure of the conductor in the termination zone, which causes the entire electrical connection to be ineffective. In order to eliminate the strain applied to the conductors in the termination zone, it would prove beneficial to have a strain relief zone provided proximate the termination zone.

Another problem associated with the device disclosed in the prior art relates to the fact the no cutting means is provided to cut off the ends of the cable. In other words, if the fine wire is not to be terminated in a daisy chain fashion, there is no means to remove the excess wire from the termination. Therefore, prior to the termination of the wire, the wire must be cut to the appropriate length and inserted into the sleeve of the connector. Using this method the positioning of the wire is critical in order to insure that a positive electrical connection is effected. It would therefore be beneficial to provide the eyelet with a cutting surface which would cut the wire to the appropriate length concurrently with the electrical termination of the wire.

SUMMARY OF THE INVENTION

The invention is directed to a connecting device for use in the termination of fine wires and the like. The configuration of the device provides for an easy means to terminate the wire, while still providing for a positive electrical connection which is effective over time.

In accordance with the invention, the connecting device has a post member and a sleeve member, each of which has tapered portions. One of the members includes a series of serrations which cooperate with conductors which are provided between the post member and the sleeve member. The post and the sleeve members are adapted for engagement, such that as the post member is wedged in the sleeve member, against one or more conductors to be terminated, the serrations bite into the one or more conductors to provide a low resistance stable interface with the member carrying the serrations. A cutting means is provided proximate the serrations, the cutting means being dimensioned such that as the post member is wedged in the sleeve member, the cutting means cooperates with the conductors to severe a portion of the conductors.

According to another aspect of the invention, the connecting device has a strain relief means provided proximate the serrations. The strain relief means is dimensioned such that as the post member is wedged in the sleeve member, the strain relief means cooperates with the conductors to maintain the conductors in position relative to the sleeve member.

DETAILED DESCRIPTION OF THE INVENTION

Figure 1:
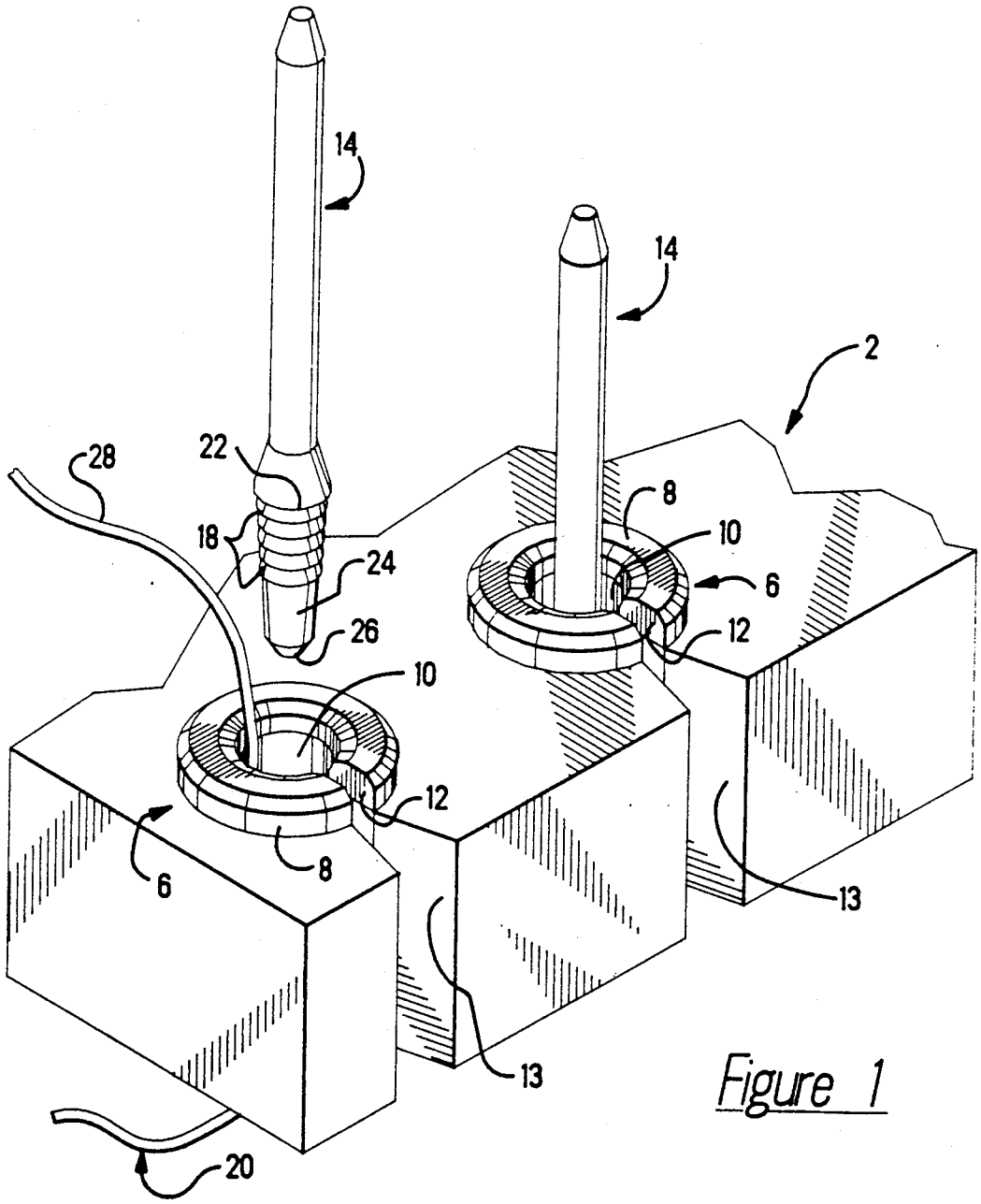
FIG. 1 is a perspective view of the components of the invention, the pin on the left is shown prior to termination, and the pin on the right is shown after termination.

Referring to FIG. 1, there is shown a mounting block 2. Secured to the block 2 are respective eyelets or sleeves 6 which are made from conductive material. The sleeves have flanges 8, 9 which are provided in engagement with block 2. An opening 10 extends through each sleeve 6, so that a fine wire insulated conductor 20 and a conductive post 14 may be inserted into the sleeve 6. A slot 12 is provided in sleeve 6, and extends from flange 8 to flange 9. The slot 12 allows the fine wire 20 to be inserted therein. The slot also provides the sleeve with the resilient characteristics required when sleeve 6 is inserted into block 2. A slot 13 is also provided in block 2, as shown in FIG. 1. The slots 12 and 13 are aligned as required.

In the embodiment shown in the drawings, the posts 14 include a number of fine serrations forming piercing edges 18 which are adapted to pierce through the insulation of conductors 20 and form an electrical contact therewith. The eyelet or sleeve 6, as well as the posts 14, include slight tapers so that upon being driven into contact, a tight interlocking fit is formed resulting in the conductors being electrically and mechanically connected to the sleeve 6.

Figures 2, 3, 4:
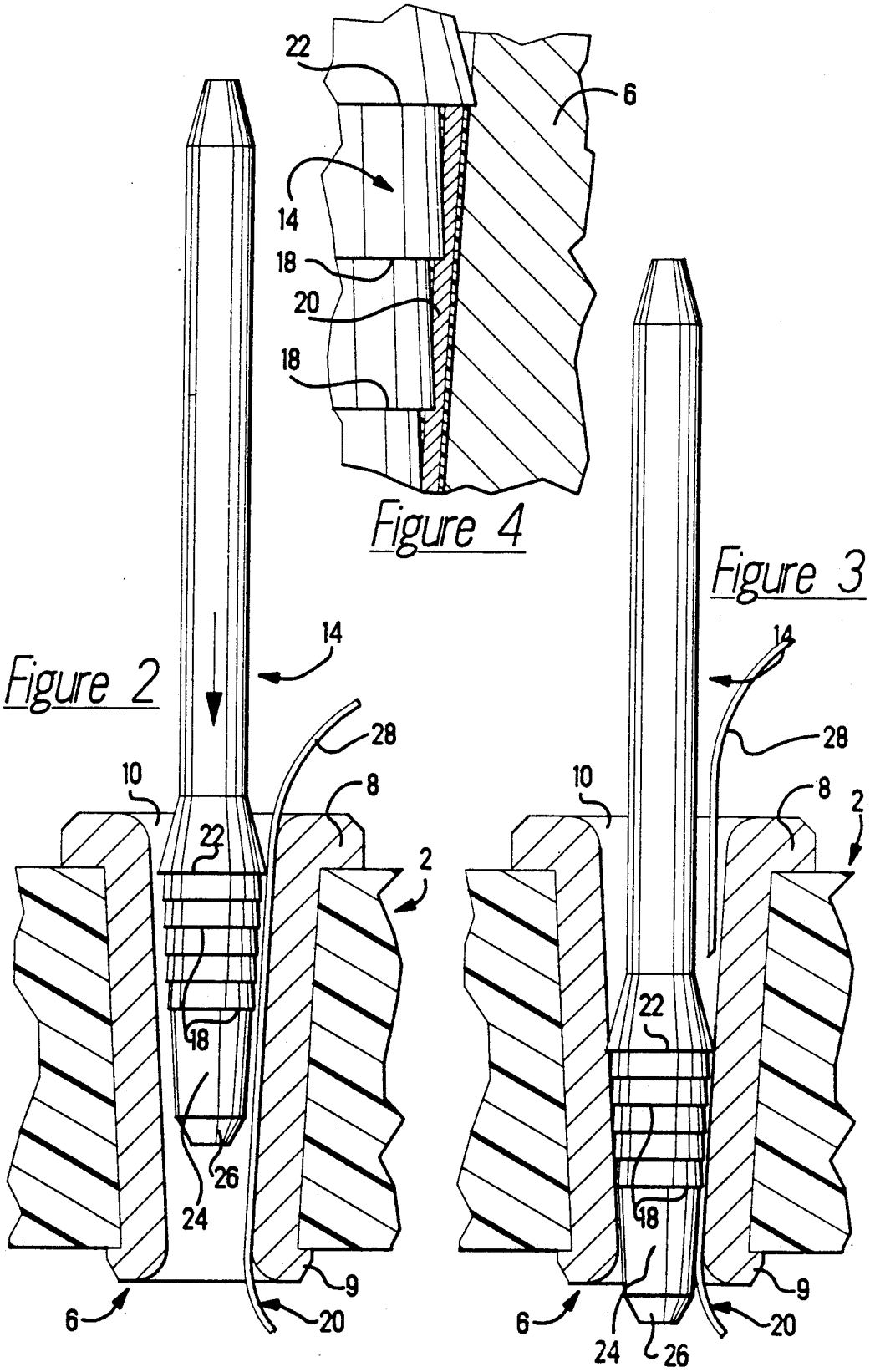
FIG. 2 is a sectional view showing the fine wire inserted into a sleeve, the pin with serrations provided thereon is shown just prior to insertion into the sleeve.
FIG. 3 is a sectional view similar to FIG. 2, showing the pin with serrations inserted into the sleeve in the terminated position, a portion of the wire has been severed and is shown prior to removal thereof.
FIG. 4 is an enlarged sectional view showing the cooperation of the serrations with a fine wire.

Referring to FIGS. 2 and 3, a cutting blade 22 is provided proximate the piercing edges 18. The cutting blade 22 extends from the post 14 a greater distance than piercing edges 18 of the serrations. This configuration allows the cutting blade 22 to engage the conductor 20 and cut the excess portion of the conductor therefrom. The cutting blade 22 also acts as a retention means, due to the fact that the blade will deform the side walls of the opening 10 of sleeve 6, thereby causing a frictional retention therebetween. These features of the cutting edge 22 will be more fully discussed below.

Strain relief zone 24 is positioned on post 14 proximate piercing edges 18. The strain relief zone 24 and the cutting edge 22 are provided on opposed sides of the piercing edges 18. The angle of the taper associated with the strain relief zone 24 is essentially identical to the angle of the taper of the zone which has the piercing edges 18 provided thereon. A lead-in surface 26 is positioned proximate strain relief zone 24. The lead-in surface 26 cooperates with the opening 10 of the sleeve 6, to insure that the post 14 is properly inserted in the sleeve.

In the usual assembly of the device, a respective eyelet or sleeve 6 is inserted into an opening of the block 2 and flared to form flanges 8 which lock the sleeve in position relative to the block 2.

For ease of explanation and understanding, the remaining portion of the assembly process will be described with reference to only one respective sleeve 6, however the same process is used for any number of terminations which are to occur.

With the sleeve 6 properly positioned in block 2, the fine wire or conductor 20 is inserted through the slot 12, 13 of sleeve 6 and block 2 to the position shown in FIGS. 1 and 2. It should be noted that the end 28 of the conductor 20 extends beyond the opening 10 of the sleeve 6. As the length of the conductor 20 which extends from opening 10 is not significant, no accurate alignment means is required to position the conductor in the opening 10.

Post 14 is positioned in opening 10 and moved in the direction of the arrow shown in FIG. 2. The lead-in surface 26 of the post cooperates with the wide portion of the opening in order to facilitate the insertion of the post into the opening. The post in then moved from the partially assembled position, shown in FIG. 2, to the fully assembled position, shown in FIG. 3.

As the post is moved to the fully assembled position, the post cooperates with the conductor 20, to electrically connect the conductor to the sleeve 6. In order to accomplish the electrical connection, the tapered post portion, including piercing edges 18, passes downwardly (as indicated by the arrow in FIG. 2) wedging the conductor 20 against a body portion of the sleeve 6 and forming a tight interlocking fit therewith. As both the post and sleeve are tapered, the insertion of the post into the sleeve causes the post, and in particular the piercing edges 18, to engage the side wall of the opening 10, thereby forcing the piercing edges into the conductor 20, as shown in FIG. 3.

Concomitantly, the piercing edges 18 bite into the conductor 20, piercing the conductor insulation and penetrating well into the conductive material as the conductor 20 is progressively flattened by the post 14. The leading piercing edges 18 first pierce through the insulation and then wipe the conductive material along its length cleaning away oxidation products and exposing the conductive material to the other piercing edges 18. As there are a plurality of piercing edges, a redundant electrical connection is provided to insure that the electrical connection will be reliable.

FIG. 4 shows an enlarged section of the piercing edges 18 penetrating the conductive material. Each of the edges 18 is formed of intersecting surfaces inclined with respect to the longitudinal axis of the post. The conductor insulation is stripped and spread apart under the pressure of insertion of post to form two legs disposed on either side of the conductive material from the point to the end of the conductor. The individual piercing edges form contact areas with the conductive material.

The strain relief zone 24 also cooperates with the conductor 20 as the post 14 is moved to the fully assembled position. As shown in FIG. 3, the strain relief zone traps the conductor 20 between the side wall of the opening 10 and a side surface of the strain relief zone 24. As the conductor is trapped between the strain relief zone and the side wall of the opening, the conductor is prevented from movement relative to sleeve 6. Consequently, if a force is applied to the conductor, the force will be transmitted to the portion of the conductor 20 which is in engagement with the strain relief zone 24. As the conductor 20 is intact, and therefore relatively strong, the distribution of the force to the conductor at the strain relief zone will not damage the conductor. In contrast, if the force is distributed to the portion of the conductor which is in engagement with the piercing edges 18, as was done in the prior art, the conductor is likely to fail because the conductor is made relatively weak by the cooperation of the piercing edges with the conductors.

The movement of the post 14 to the fully inserted position also causes the cutting blade 22 to cooperate with the conductor 20. As is shown in FIG. 2, the cutting blade 22 engages the conductor 20 prior to the piercing edges 18. Consequently, as the post 14 is moved to the fully assembled position, the cutting blade 22 will cut through the entire conductor, rather than just pierce the insulation. The severed portion of the conductor can then be discarded. Incorporated the cutting blade proximate the piercing edges 18 insures that the conductor will not be exposed to make accidental electrical contact with any other component. The incorporation of the cutting blade on the post also eliminates the need for the operator/installer to cut the excess portion of the conductor after the termination has been completed.

The movement of the post 14 to the fully inserted position also causes the cutting blade 22 to act as a retention means. As the post is inserted into the sleeve 6, the cutting blade 22 will be forced into the side wall of the opening 10 of the sleeve 6. This will cause the cutting blade 22 to deform the side wall, thereby providing a retention fit between the side wall and the post 14.

Figure 5:
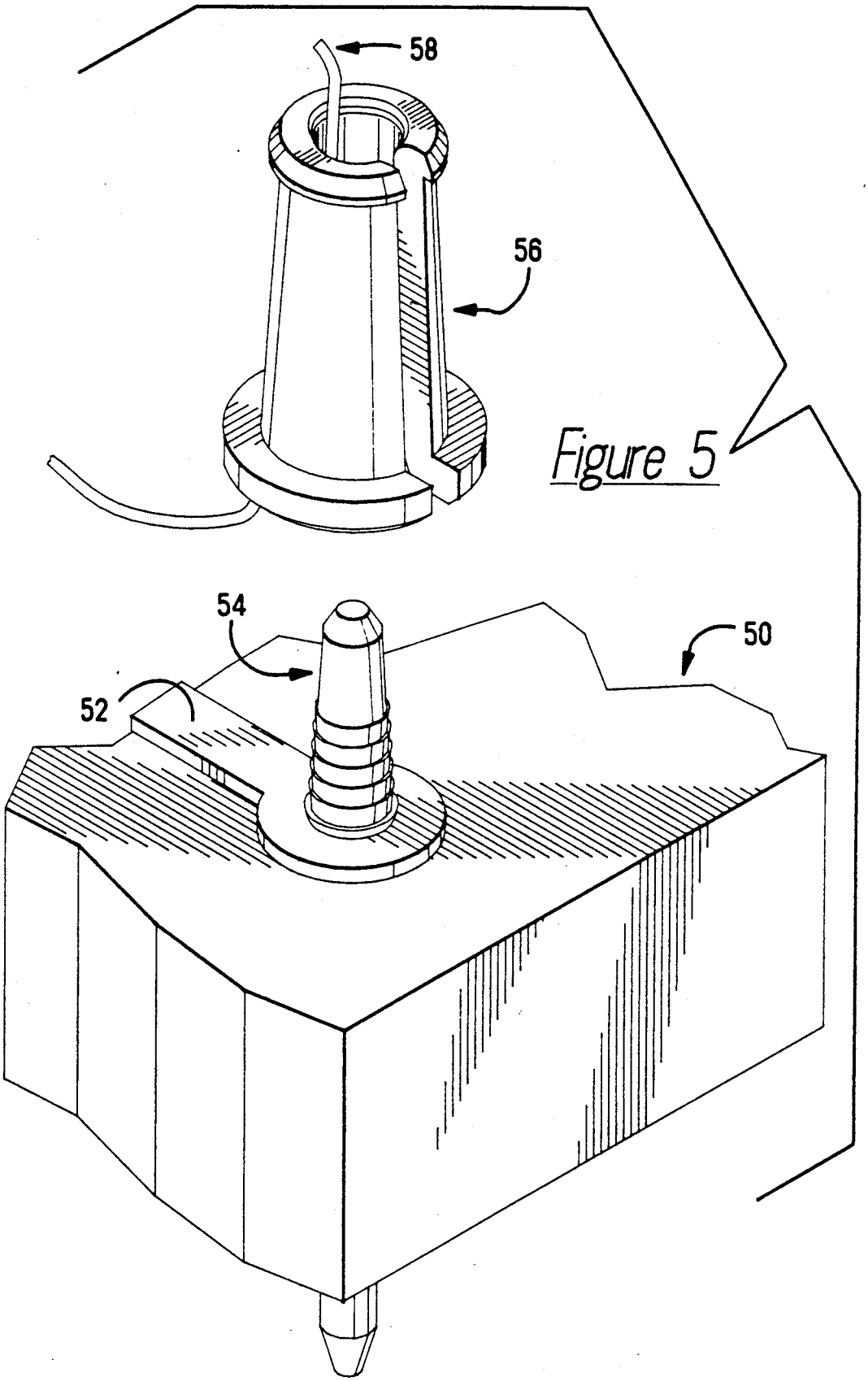
FIG. 5 is a perspective view of an alternative embodiment of the present invention showing a termination to a printed circuit board.

The invention described herein is not limited to use with the embodiment shown in FIGS. 1 through 4. As an example, an alternative embodiment is shown in FIG. 5. Mounted either on or within a printed circuit board 50 is a conductive path 52 which may be considered as connected to other components (not shown) mounted on the board 50, which are in turn connected to suitable input or output devices (not shown) associated with the circuits being formed. Provided proximate to and in electrical engagement with the conductive path 52 is a post 54 which extends from the printed circuit board 50. A sleeve 56 with a conductor 58 positioned therein is moved into engagement with post 54 to provide the electrical connection required between the conductor 58 and conductive path 52. The configuration of the post 54 and the sleeve 56 are essentially identical to the post 14 and sleeve 6, and as the method of termination is similar, a further explanation of this embodiment is not provided.

In other alternate circumstances, the post described herein would not be placed in a board, but would rather be used independently. As an example of an alternate embodiment, the post could be used as the pin in a pin and socket type arrangement.

In various applications it may be necessary to terminate more than one conductor. In such circumstances, several conductors are positioned in the sleeve and the termination is performed in the same manner as was previously described.

Several advantages are provided by the device disclosed herein. First, the incorporation of the strain relief provides the means to insure for the reliability of the electrical connection. As the strain relief cooperates with a relatively strong portion of the conductor, the rate of failure of the wire is reduced. Second, the cutting blade provides an easy and effective means to remove the excess portion of the conductor. Consequently, the operator/installer does not require an extra step to remove the excess conductor. A third advantage relates to the configuration of the sleeve and post. As each member has the same features provided about its circumference, the alignment of the conductor with respect to the members is not critical. In other words, the conductor can be provided in any position in the sleeve, and the electrical connection will be effected. The ability to terminate multiple conductors in the same sleeve is a fourth advantage.

Changes in construction will occur to those skilled in the art and various apparently different modifications and embodiments may be made without departing from the scope of the invention. The matter set forth in the foregoing description and accompanying drawings is offered by way of illustration only.

I claim:

1. A connecting device including a post member and a sleeve member, each having tapered portions, one of the members including a series of serrations, the post and the sleeve members being adapted for engagement with the post member being wedged in the sleeve member against one or more conductors to be terminated such that the serrations bite into the one or more conductors to provide a low resistance stable interface with the member carrying the serrations, the connecting device being characterized in that:

a cutting means having a cutting blade provided thereon is provided proximate the serrations, the cutting means being dimensioned such that as the post member is wedged in the sleeve member against one or more conductors the cutting blade cooperates with the conductors to sever a portion of the conductors, the serrations, the cutting means, and the strain relief means are provided on the post member.

2. A connecting device as set forth in claim 1 characterized in that strain relief means is provided proximate the serrations, the strain relief means being dimensioned such that as the post member is wedged in the sleeve member against one or more conductors, the strain relief means cooperates with the conductors to maintain the conductors in position relative to the sleeve member.

3. A connecting device as set forth in claim 2 characterized in that the sleeve member has an opening which extends therethrough, the opening having a side wall which extends about the circumference thereof, the diameter of the opening being greater than the diameter of the post member, such that the post member may be inserted into the opening.

4. A connecting device as set forth in claim 3 characterized in that the serrations have piercing edges which cooperate with the conductors as the post member is inserted into the opening, the piercing edges piercing the insulation of the conductors, and thereby placing the conductor in electrical engagement with the connecting device.

5. A connecting device as set forth in claim 1 characterized in that the taper of the post member and the taper of the sleeve member are substantially constant along the length thereof.

6. A connecting device as set forth in claim 5 characterized in that the taper of the post member and the taper of the sleeve member are substantially identical.

7. In an electrical connection the combination comprising a conductive post member, a conductive sleeve member surrounding the post member and having an inner surface extending longitudinally along the length of the sleeve member, a space being provided between the post and the sleeve members when the post member is fitted into the sleeve member, a conductive lead positioned in the space between the members, a series of serrations forming piercing edges extending around the surface of one of the members in a sense transverse to the longitudinal axis thereof, said at least one conductive lead fitted within the space extending therealong between an outside surface of the post member and the inside surface of the sleeve member with the post member being axially driven relative to the sleeve member to substantially deform the lead along the length and to wedge the post member into an interlocking frictional fit within the sleeve member to entrap and terminate the lead to one of the members, the combination being characterized in that:

a cutting means having a cutting blade provided thereon is provided proximate the serration, the cutting means being dimensioned such that as the post member is wedged in the sleeve member, against one or more conductors the cutting blade cooperates with the conductors to sever a portion of the conductors, the serrations, the cutting means, and the strain relief means are provided on the post member.

8. The combination as set forth in claim 7 characterized in that strain relief means is provided proximate the serrations, the strain relief means being dimensioned such that as the post member is wedged in the sleeve member against one or more conductors, the strain relief means cooperates with the conductors to maintain the conductors in positions relative to the sleeve member.

9. The combination as set forth in claim 7 characterized in that the serrations have piercing edges which cooperate with the conductors as the post member is inserted into the opening, the piercing edges piercing the insulation of the conductors, and thereby placing the conductor is electrical engagement with the connecting device.

10. The combination as set forth in claim 7 characterized in that the post member and the sleeve member have tapered surfaces.

11. The combination as set forth in claim 10 characterized in that the taper of the post member and the taper of the sleeve member are substantially constant along the length thereof.

12. The combination as set forth in claim 10 characterized in that the taper of the post member and the taper of the sleeve member are substantially identical.

* * * * *